United States Patent [19]

Saito

[11] Patent Number: 4,760,888

[45] Date of Patent: Aug. 2, 1988

[54] DRILL BIT FOR CORE BORING

[75] Inventor: Makoto Saito, Chiba, Japan

[73] Assignee: Tone Boring Company Limited, Tokyo, Japan

[21] Appl. No.: 914,926

[22] Filed: Oct. 3, 1986

[30] Foreign Application Priority Data

Apr. 1, 1986 [JP] Japan ..... 61-75172
Apr. 28, 1986 [JP] Japan ..... 61-98845

[51] Int. Cl.[4] ..... E21B 10/66

[52] U.S. Cl. ..... 175/259; 175/261; 175/330

[58] Field of Search ..... 175/257–261, 175/330

[56] References Cited

U.S. PATENT DOCUMENTS

| | | | |
|---|---|---|---|
| 1,996,132 | 4/1935 | Walker | 175/258 |
| 3,603,411 | 9/1971 | Link | 175/259 |
| 3,603,413 | 9/1971 | Grill et al. | 175/261 |
| 3,692,126 | 9/1972 | Rushing et al. | 175/259 |
| 4,470,470 | 9/1984 | Takano | 175/260 |

FOREIGN PATENT DOCUMENTS

| | | |
|---|---|---|
| 60-23591 | 2/1985 | Japan . |
| 60-129390 | 7/1985 | Japan . |

*Primary Examiner*—James A. Leppink
*Assistant Examiner*—Hoang C. Dang
*Attorney, Agent, or Firm*—Robbins & Laramie

[57] ABSTRACT

A drill bit for core boring of the type provided with a multi-layered bit head, so constructed that when the blades of the upper-layered bit head have become worn out, it is possible to easily withdraw them without removing the bit from the bore. The core boring operation is then continued without delay by using the blades of the newly exposed lower-layered bit head. The drill bit is also so constructed that it is possible to eliminate any displacement of the upper layer blades from their fitted position on the blades of the lower layer blades during drilling by using the upper layer blades and at the same time, it is possible to easily disengage the engagement between the bit body and the upper layer blades when the upper layer blades have become worn out.

10 Claims, 11 Drawing Sheets

DRILL BIT FOR CORE BORING

BACKGROUND OF THE INVENTION

1. Field of the Invention

The present invention relates to drill bits for core boring practiced when excavating rock-beds, and more particularly to a drill bit of this kind which has a multi-layered bit head which may be exchanged at the bottom of the bore being drilled.

2. Description of the Prior Art

Core boring has conventionally been practiced for collecting core samples of a stratum when conducting excavation of the same. More specifically, core boring is carried out by rotating a drill bit mounted on the tip end of a boring rod and drilling a bore by means of cutting blades formed at the tip end of the drill bit. However, since the usable life of such cutting blades will come to an end due to wear when drilling proceeds over a certain depth, the blades of the drill bit have to be exchanged during the course of drilling. Unfortunately, the structure of a conventional drill bit is such that it has been necessary when the usable life of the blades ends to pull up the boring rod out of the bore to allow the used blades to be removed and replaced with new ones.

Thus, the usage of a conventional drill bit has involved pulling up the boring rod out of the bore being drilled whenever the operation has required exchange of the blades, thus causing loss of time in raising and lowering the boring rod. The problem has been particularly serious as the depth of a bore drilled increases because the loss of time will increase correspondingly. Therefore, various types of diamond bit for core boring have been proposed which have such structures that the blades can be exchanged at the bottom of the bores without requiring that the boring rods be pulled up out of the bores.

For instance, the present applicant has previously proposed drill bits for core boring as disclosed in Japanese Patent Publications Nos. 60-23591, and 60-129390. A drill bit in accordance with the present applicant's previous proposals comprises: a cylindrical bit body provided with a bit head having cutting blades at its tip portion, and protruding portions at its inner surface; an upper layer bit head including upper layer blades superposed on the cutting blades, rings engaged with the protruding portions on the inner surface of the bit body, and legs connecting between the rings and the upper layer blades; and a disengaging mechanism received in the bit body and operative to disengage the engagement between the protruding portions and the rings, so that the bit heads can be exchanged at the bottom of the bore being drilled.

With the drill bits disclosed in the above Japanese Patent Publications, however, it has been difficult for their structure to simultaneously satisfy the following requirements because these requirements basically run counter to each other: When the upper layer blades are used in drilling, the working upper layer blades should never be displaced relative to the head of the bit body on which the working blades are superposed. On the other hand, when the upper layer blades become worn out and reach the end of their usable life and therefore have to be withdrawn, the used upper layer blades should be capable of being easily removed from their superposed position.

SUMMARY OF THE INVENTION

It is an object of the present invention to provide a drill bit for core boring having a multi-layered bit head and adapted to allow exchange of bits at the bottom of a bore being drilled which is provided with a structure which ensures both a stable layered-condition of the bits during the core boring operation and easy removal of an upper layer bit at the time of withdrawal of the same.

According to the present invention, there is provided a drill bit for core boring comprising: a cylindrical bit body provided at the tip portion thereof with a bit head having cutting blades and at an inner surface thereof with at least one protruding portion; an upper layer bit head having upper layer blades superposedly fitted on the cutting blades, a plurality of legs each fixed at one end thereof to the corresponding one of the upper layer blades and extending in the axial direction of the bit body, and at least one ring extending in the circumferential direction of the bit body in such a manner as to be connected to at least part of the legs and engageable with the at least one protruding portion, the diameter of the ring being capable of reduction; and a disengaging mechanism received within the bit body and operable to disengage the engagement of the at least one ring with the at least one protruding portion, wherein the outer peripheral surface of the cutting blades of the bit body have an irregular configuration, the inner peripheral surface of the upper layer blades having a configuration transferred from the irregular configuration of the outer peripheral surface of the cutting blades of the bit body, and the protruding portion of the bit body is provided with a portion which can be sheared off by the shearing force of the ring of the upper layer bit head which works circumferentially when the diameter of the ring is reduced.

According to the above arrangement of the invention, it is possible to eliminate any displacement of the upper layer blades from their fitted positions on the cutting blades of the bit body during drilling by using the upper layer blades, while also making it possible to easily disengage the engagement between the bit body and the upper layer blades when the upper layer blades have become worn out, by operating the disengaging mechanism so as to allow the ring to be reduced in diameter, and by shearing off the portion provided for the protruding portion of the bit body by means of the shearing force of the ring thus caused therein. After this disengagement, the upper layer bit head comprising the upper layer blades is withdrawn by being allowed to pass through the cylindrical bit body, and the core boring operation is then continued by using the thus newly exposed bit head of the bit body.

According to one aspect of the invention, the upper layer blades consist of a plurality of blades divided into two groups, this arrangement enabling removal and withdrawal of the blades in two steps, and also enlargement of the cutting blade area of the upper layer bit head to such an extent that the cutting blade area of the same will be substantially the same as that of the bit head of the bit body.

Further, according to another aspect of the invention, the above advantage, i.e. elimination of displacement of the upper layer bit head relative to the bit body during drilling by using the former, can be attained not only with the so-called surface-type diamond bit but also with the so-called impregnated-type diamond bit, by, in the case of the latter, providing protrusions on the outer surface of the cutting blades of the bit body, and by providing the inner surface of the upper layer bit head with a configuration transferred from the configuration of the outer surface of the tip ends of the cutting blades of the bit body which outer surface includes the protrusions, thereby stabilizing the layered conditions of the bit heads, and thus improving the efficiency of drilling also in the case of the impregnated-type diamond bit. The above so-called surface-type diamond bit includes cutting blades of a bit body which are formed of a head metal body and diamonds embedded in the metal body in such a manner as to protrude from the outer surface of the metal body, and an upper layer bit head assembled on the cutting blades of the bit body, the configuration of protrusions formed by the diamonds protruding from the outer surface being transferred to the inner surface of the upper layer bit head by sintering powder metal. The above so-called impregnated type diamond bit includes cutting blades of a bit body which are produced by mixing and infiltration sintering relatively fine diamonds and powder metal, and an upper layer bit head assmebled on the cutting blades of the bit body, the outer surface of the cutting blades at the tip end thereof including a plurality of protrusions of which configuration is transferred to the inner surface of the upper layer bit head by sintering powder metal.

DESCRIPTION OF THE PREFERRED EMBODIMENTS

Figure 1:
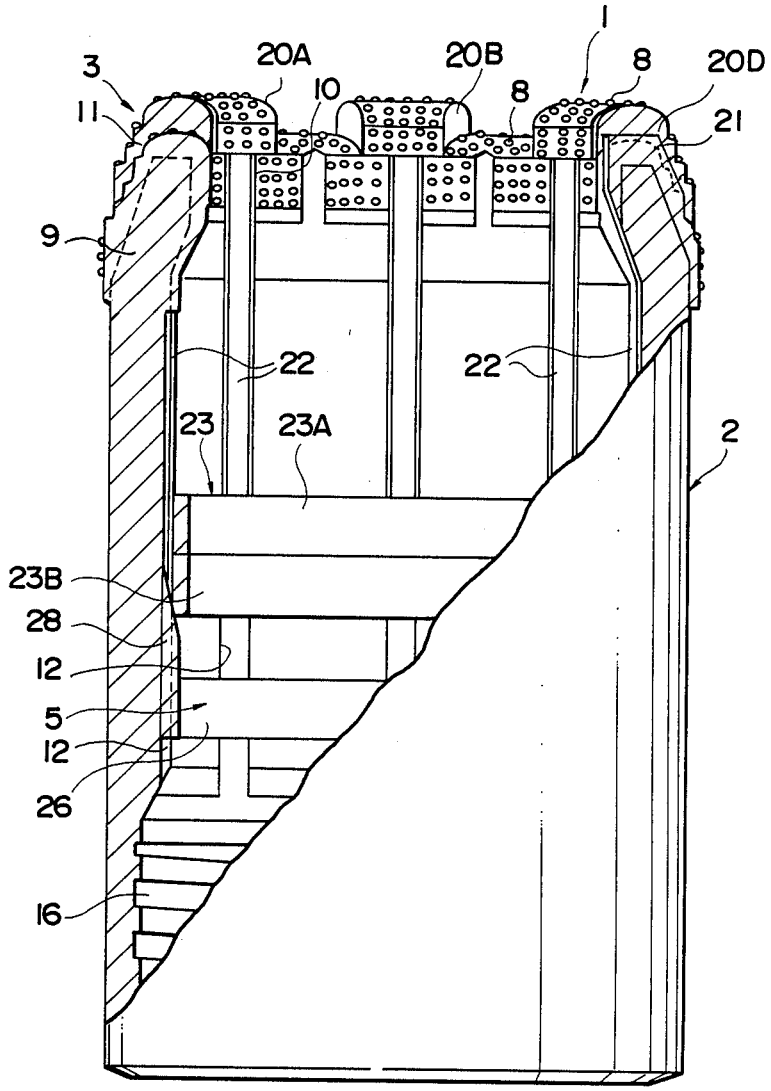
FIG. 1 is a fragmentary longitudinal sectional view of a drill bit of the surface-type in accordance with the first embodiment of the invention, in which an upper layer bit head is superposedly fitted on a bit head of a bit body.
Figure 2:
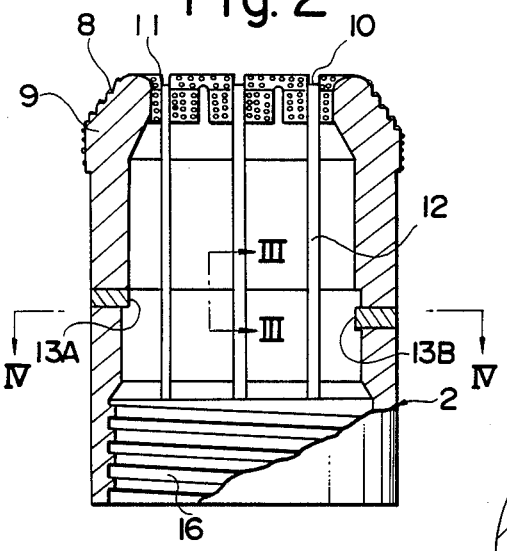
FIG. 2 is a fragmentary longitudinal sectional view of the bit body shown in FIG. 1.
Figure 3:
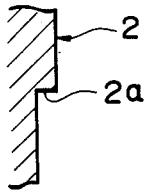
FIG. 3 is a cross sectional view taken along the line III—III in FIG. 2.

Preferred embodiments of the present invention will now be described below, with reference to the drawings.

FIGS. 1 to 8 relate to a first embodiment of the invention in which reference number 1 denotes a drill bit for core boring of the surface-type. The drill bit 1 is provided with a bit body 2, an upper layer bit head 3, a disengaging mechanism 5, and a withdrawal mechanism 6.

Figure 4:
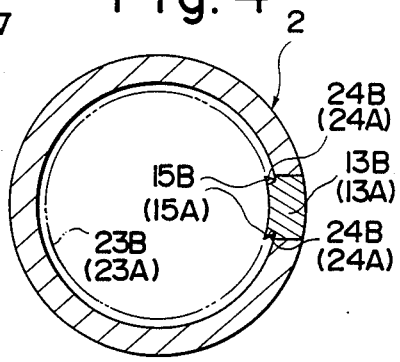
FIG. 4 is a cross sectional view taken along the line IV—IV in FIG. 2.

The bit body 2 is formed into a cylinder-like shape with steel, and has a bit head 9 made of sintered metal at the tip end thereof (the upper end as viewed in FIGS. 1 and 2) which is to be used in the drilling operation. The bit head 9 has a plurality of diamonds 8 embedded in the tip end thereof in such a manner as to protrude therefrom. A plurality of water grooves 10 are formed in the inner surface of the bit head 9. More specifically, in this embodiment, eight grooves 10 are arranged circumferentially at an equal interval, thereby forming eight cutting blades 11 of the bit head 9. On the other hand, the inner surface of the bit body 2 is arranged to have a small diameter and a large diameter, respectively, at the portion thereof which is upward of what is substantially its middle portion and at the portion thereof which is downward of the same, the boundary of these upward and downward portions being formed by a shoulder **2*a* (in FIG. 2). In the inner surface of the bit body 2, a plurality of water grooves 12 are axially formed which are continuous with the above water grooves 10. Further, a pair of protruding portions 13A and 13B (in FIG. 2), which are provided for respectively engaging with the corresponding rings of the pair consisting of an upper ring 23A and a lower ring 23B (described later) which are constituents of the upper layer bit head 3, are fixed to the bit body 2 at locations downward of the shoulder 2*a* by a suitable method such as welding. More specifically, these protruding portions 13A and 13B are diametrically opposed to each other and are axially displaced relative to each other by a distance corresponding to the axial size of the upper ring 23A. As shown in FIG. 4, each of the protruding portions 13A and 13B is provided on its radially inward side with a portion 15A or 15B to be sheared off, each of which has its circumferential ends formed into the shape of a wedge with respect to the inner surface of the bit body 2 and is made of a material, e.g. a Zn alloy, which is softer than the ring member 23**.

Figure 7:
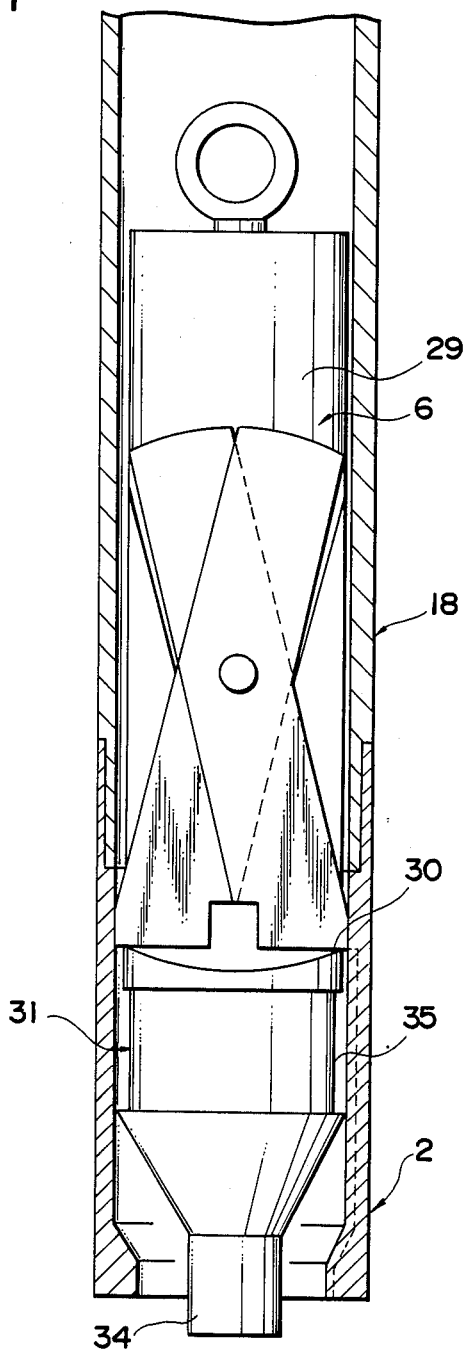
FIG. 7 is a fragmentary longitudinal sectional view of a boring rod, which shows a withdrawal mechanism for the drill bit, by way of an example.

An internal thread 16 is formed in a lower portion of the inner surface of the bit body 2, whereby the bit body 2 is mounted on the tip end of a boring rod 18, as shown in FIG. 7.

The upper layer bit head 3 is superposedly fitted on the upper end of the bit head 9 of the bit body 2 and the design is such that, when removal of the same is required, it is possible for the upper layer bit head 3 to be withdrawn through the inside of the bit body 2, in a manner to be described later.

The upper layer bit head 3 will be described below in detail. The upper layer bit head 3 has a plurality of divided upper layer blades 20A, 20B, 20D, . . . , with shanks 21 being fixed to these blades on the inside thereof. By fitting the shanks 21 into the water grooves 10 of the bit head 9, the upper layer bit head 3 can be maintained in a layered condition in which the head 3 is superposedly fitted on the upper end of the bit head 9. The inner surface of the upper layer blades 20A, 20B, . . . are formed in conformity with the configuration of the outer peripheral surface of the cutting blades 11 of the bit body 2 as the matrix, by infiltration sintering powder metal so that the inner surface configuration of the blades 20 of the upper layer bit head 3 is transferred from the outer surface configuration of the blades 11 of the bit body 2 and is complementary therewith. Preferably, the infiltration sintering temperature should be on the order of 900° C., which is below the sintering temperature of the bit head 9 of the bit body 2. Legs 22 are fixed at one of the ends thereof to the shanks 21 of corresponding blades 20A, 20B, . . . of the upper layer bit head 3 and at the other ends thereof to the outer periphery or the end surface of corresponding rings 23.

Incidentally, the legs 22 may be formed integrally with the rings 23.

Figure 5:
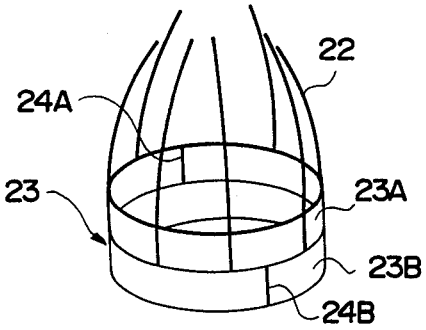
FIG. 5 is a perspective view showing the relationship between legs of the upper bit head and rings of the same, by way of an example.

The relationship between the legs 22 and the rings 23 will now be described. Referring to FIG. 5, the legs 22 are made of an elastic material and have elastic forces which act radially inwardly of the bit body 2, so that when required, the upper blades 20A, 20B, . . . fixed to the upper ends of the legs 22 can be withdrawn through the inside of the bit body 2. In the normal condition, the legs 22 are located in radial locations that are displaced in the inward direction to such an extent that withdrawal of the upper blades 20A, 20B, . . . , when required, will not be impossible due to any part of the blades 20 being caught on the bit head 9 of the bit body 2. Meanwhile, the rings 23 to which the lower ends of the legs 22 are fixed comprise the upper ring 23A and the lower ring 23B which are made of a material, e.g. steel, which is harder than that of the portions 15A and 15B to be shearedoff. Each of the rings 23A and 23B has a slit 24A or 24B, whereby the rings 23 can be enlarged or reduced in diameter, i.e. increased or decreased in circumferential size. The circumferential ends of each slit 24A and 24B is formed into the shape of a wedge so as to engage with the circumferential ends of the portions 15A or 15B to be sheared off.

The legs 22 are fixed to the rings 23 at lateral surfaces of the rings 23 which are substantially diametrically opposed to the corresponding slits 24A and 24B of the same. More specifically, in the arrangement shown in FIG. 5, the legs 22, four of them each, are fixed to the lateral surfaces of the rings 23A and 23B which are respectively opposite to the slits 24A and 24B. In this condition, the legs 22 are disposed in the circumferential direction at the same interval as the interval at which the water grooves 10 are formed in the bit head 9 of the bit body 2. Incidentally, as long as the legs 22 are to be made of a material which allows the legs 22 to be located at the above radial locations, such materials as shape memory alloys can suitably be used.

Figure 6:
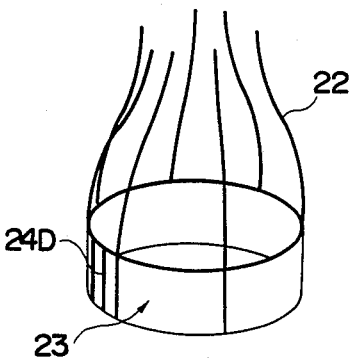
FIG. 6 is a view similar to FIG. 5 showing another example of the relationship of the legs and the rings shown in FIG. 5.

The reasons why the legs are fixed at lateral surfaces of the rings 23 which are opposite to the slits 24 are as follows: Since the rings 23 are fitted on the inner surface of the bit body 2 with their slits 24 opened or enlarged in circumferential size, if the legs are fixed to the rings independently of the locations of the slits 24 formed in the rings 23, the circumferential interval at which the legs 22 are disposed in the vicinity of the rings 23 and that at which they are disposed away from the rings 23 can not be aligned as the diameters are reduced by the rings 23. This results in a disadvantage when the upper layer blades 20 have to be grasped which leads to an instable withdrawal of the upper layer bit head 3. On the other hand, if the legs 22 are fixed to the rings 23 at semi-circular portions thereof which are remote from the slits 24, changes in the intervals between the legs 22 which are otherwise caused by enlargement (upon fitting the rings 23 onto the bit body 2) of the circumferential sizes of the slits 24 can be eliminated. For these reasons, the legs 22 are fixed to the rings 23A and 23B in such a manner that the legs 22 are divided between these rings 23A and 23B and the fixed positions of the legs 22 relative to the rings 23 are located at respective semi-circular lateral surfaces of the rings 23. However, under a condition that, at the time of enlargement of the rings 23 in diameter (i.e. when fitting the same onto the bit body 2), the positions of the legs 22 relative to the rings 23 are such that changes in the intervals between the legs 22 do not cause any disadvantage, the arrangement shown in FIG. 6 can be used in which legs 22 are fixed to a single ring 23 having a slit 24D. In the case of FIG. 6, a single protruding portion 13 is formed on the inner surface of the bit body 2.

Within the bit body 2, the disengagement mechanism 5 is received for disengaging the engagement between the bit body 2 and the upper layer bit head 3. The mechanism 5 comprises an annular plate 26 having a certain axial size, and a plurality of wedges 28 fixed to the annular plate 26, the wedges 28 being slidably fitted in the grooves 12 formed in the inner surface of the bit body 2.

Next, an example of the withdrawal mechanism 6, which is provided for withdrawing the upper layer bit head 3 of the drill bit 1 of the invention will described with reference to FIG. 7

The withdrawal mechanism 6 is hung down within the boring rod 18 toward the bottom of a bore being drilled, in order to actuate the disengaging mechanism 5 by its own weight, thus making it possible to remove the upper layer bit head 3 from the bit body 2 and thereby bringing the bit head 3 up to the ground. The withdrawal mechanism 6 comprises a base portion 29 to which wire means is connected, a shoulder 30 for urging the disengaging mechanism 5 toward the bottom of the bore, and a withdrawal portion 31 provided at the tip end of the shoulder 30. The withdrawal portion 31 has the shape of a cylinder having a diameter which is slightly smaller than the inner diameter of the rod 18, the end portion of the withdrawal portion 31 being conically shaped and provided with a cylindrical blade-receiving portion 34. In the middle portion of the withdrawal portion 31, a clearance 35 is formed between the inner surface of the rod 18 for catching therein the upper and lower rings 23A and 23B of the upper layer bit head 3.

Figure 8:
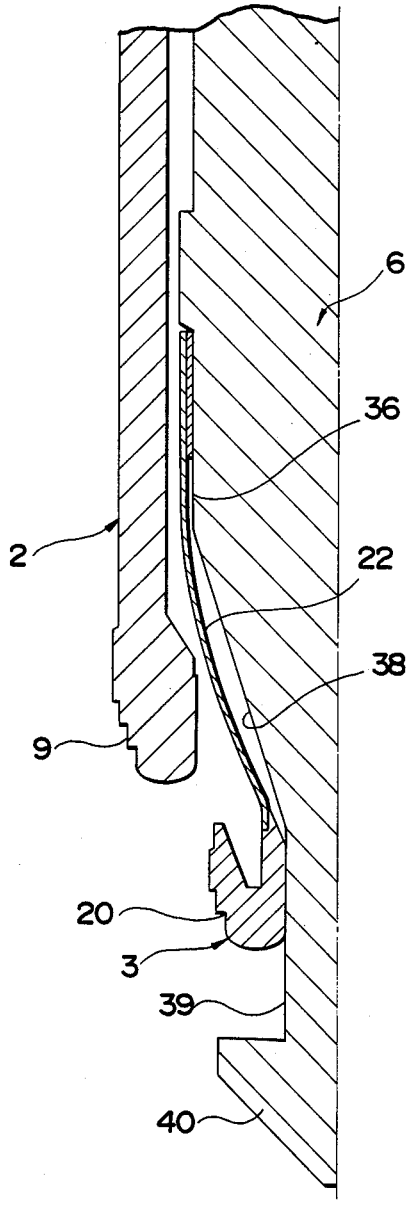
FIG. 8 is a fragmentary longitudinal sectional view of the withdrawal mechanism, which shows another example thereof.

FIG. 8 shows another example of the withdrawal mechanism 6.

In the example shown in FIG. 8, the mechanism 6 comprises a ring-fitting portion 36, a conical portion 38 which is formed to be continuous with the fitting portion 36, a receiving portion 39 for receiving the upper blades 20 which is provided at the tip end of the conical portion 39, and a large-diametered portion 40 which is provided at the tip end of the conical portion 39.

Next, assembly of the upper layer bit head 3 on the bit body 2 will be described.

The upper layer bit head 3 is inserted into the cylindrical bit body 2 from the opening thereof which is remote from the bit head 9, and passed through the body 2, until the blades 20A, 20B, . . . are axially above (as viewed in FIGS. 1 and 2) the bit head 9 of the bit body 2. The shanks 21 provided inside the blades 20A, 20B, . . . of the upper layer bit head 3 are then fitted on the water grooves 10 of the bit head 9, thereby superposedly fitting the blades 20A, 20B, . . . of the upper layer bit head 3 onto the cutting blades 11 of the bit head 9 of the body 2. On this occasion, the legs 22 fixed to the shanks 21 are fitted in the grooves 12 formed in the inner surface of the bit body 2 and in the water groove 10 formed in the inner surface of the bit head 9. In this condition, the slits 24A and 24B of the rings 23A and 23B to which the legs 22 are fixed at their lower ends, are opened in the circumferential direction in opposition to the elasticity of the rings 23, and the circumferential ends of the rings 23A and 23B thus moved away from each other are brought by the elasticity recovering force of the rings 23A and 23B into engagement with the circumferential ends of the portions 15A and 15B of the protruding portions 13A and 13B formed in the inner surface of bit body 2, with the upper end of the ring member, i.e. the ring 23A being in contact with the shoulder 2*a*. Thereafter, the annular plate 26 which is a constituent of the disengaging mechanism 5 is inserted from the opening of the bit body 2 and fitted onto the inner surface of the bit body 2, with the plurality of wedges 28 fixed to the annular plate 26 being guided along the grooves 12, thereby completing the assembly.

Next, the operation of the drill bit 1 according to the invention will be described.

The drill bit 1 is mounted on the boring rod 18 to allow the drilling of a bore to be undertaken, firstly by the upper layer bit head 3. During this drilling, since the shanks 21 fixed inside the upper layer blades 20A, 20B, . . . are firmly fitted into the water grooves 10 formed in the inner surface of the bit head 9 of the bit body 2, and at the same time, are subjected to loads in the perpendicular direction, any disengagement of the upper layer bit head 3 from the bit body 2 which would lead to the drill bit 1 becoming inoperable is prevented.

Further, the shoulder 2*a* acts as a stopper means for preventing the disengagement of the rings 23 from their fitted positions which might otherwise be caused by the movement of the bit body 2 in the perpendicular direction.

When the drilling operation proceeds to a certain depth with the drill bit in the above condition, the upper layer bit head 3 is worn out and reaches the end of its usable life. At this stage, a core tube (not shown) is pulled out, and the withdrawal mechanism 6 is lowered within the boring rod 18. When the shoulder 30 knocks the end surface of the annular plate 26 of the disengaging mechanism 5, the annular plate 26 is axially displaced toward the bottom of the bore, thus causing displacement of the wedges 28 in such a manner as to cause them to enter the gaps between the rings 23 and the bottom of the groove 12, which, in turn, causes shearing of the portions 15A and 15B of the protruding portions 13A and 13B by the slits 24A and 24B of the rings 23 and results in the disengagement of the rings 23A and 23B from the protruding portions 13A and 13B. Simultaneously, as the upper layer bit head 3 is thus brought into a condition ready to be axially displaced toward the bottom of the bore, the disengaged rings 23 reduce in diameter and enter the clearance 35 formed around the withdrawal portion 31. On this occasion, if the upper layer bit head 3 is slightly away from the bottom of the bore, the withdrawal mechanism 6 is further displaced toward the bottom, causing displacement of the received rings 23 which, in turn, push the upper layer bit head 3 toward the bottom of the bore. As a result, the upper layer bit head 3 is freed from its engagement with the bit body 2 at the water grooves 10 and is grasped by the elasticity of the legs 22 to such an extent that the bit head 3 can pass through the bit body 2. By pulling out the withdrawal mechanism 6 with the upper layer bit head 3 in this tightly grasped condition, the upper layer bit head 3 can be brought up to the ground.

According to the first embodiment of the invention described above, when assembling the upper layer bit head 3 on the bit body 2, the slits 24 of the rings 23 are brought into a wedge-shaped firm engagement with the protruding portions 13 at the portions 15 to be sheared off, thereby making it possible to perform a stable drilling operation without the risk of disengagement of the rings 23 from the protruding portions 13. Further, when withdrawing the upper layer bit head 3, the slits 24 of the rings 23 shear off the portions 15, thus releasing the engagement between the protruding portions 13 and the rings 23 and thereby enabling an easy withdrawal operation. Also in the withdrawal, the upper layer bit head 3 whose usable life has ended can be removed from its superposed position by operating the disengaging mechanism 5 from the ground, thereby making it possible to reduce the number of times it is required to raise the boring rod 18 out of the bore which might otherwise cause a loss of time in the drilling operation. Furthermore, during the drilling operation, the upper layer bit head 3 which is layered on the bit body 2 has an inner peripheral surface the configuration of which is formed by transferring the configuration of the outer peripheral surface of the cutting blades 11 of the bit body 2, and thus the inner peripheral surface of the blades 20 of the upper layer bit head 3 engages with the outer peripheral surface of the blades 1 of the bit body 2 in such a manner as to be complementary therewith, thereby preventing any displacement of the former 3 from its layered position on the latter 2 which might otherwise be caused by the force applied to the upper layer bit head 3 in the direction of rotation (in the lateral direction in FIG. 1), and also preventing damage of the diamonds 8 embedded on the bit body 2.

FIGS. 9 to 17 relate to a second embodiment of the invention. In these figures, the same component parts as those in the first embodiment are denoted by the same numbers, detailed description of which will be omitted.

In the same manner as in the previous embodiment, a drill bit in accordance with the second embodiment of the invention mainly comprises a cylindrical bit body 2 which is mounted on a boring rod, and an upper layer bit head 3 which is fitted on the tip end of the bit body 2. The bit body 2 has at its tip end which is to be used in drilling a bit head 9 in which a plurality of diamonds 8 are embedded. The bit head 9 is formed with a plurality of water grooves 10 which extend continuously in the inner and outer surfaces of the bit head 9. Particularly, in this embodiment, eight water grooves 10 are provided for the bit head 9 which extend circumferentially and are located at equal intervals, whereby eight cutting blades 11 are formed in the bit head 9.

Figure 13:
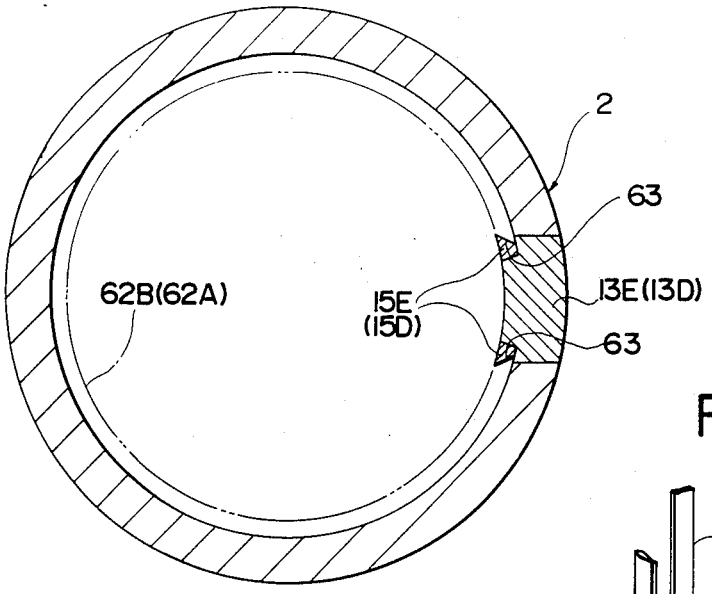
FIG. 13 is a cross sectional view taken along the line XIII—XIII in FIG. 10.
Figure 14:
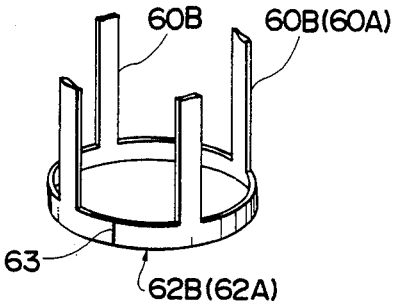
FIG. 14 is a perspective view of a ring of the drill bit shown in FIG. 9.
Figure 15:
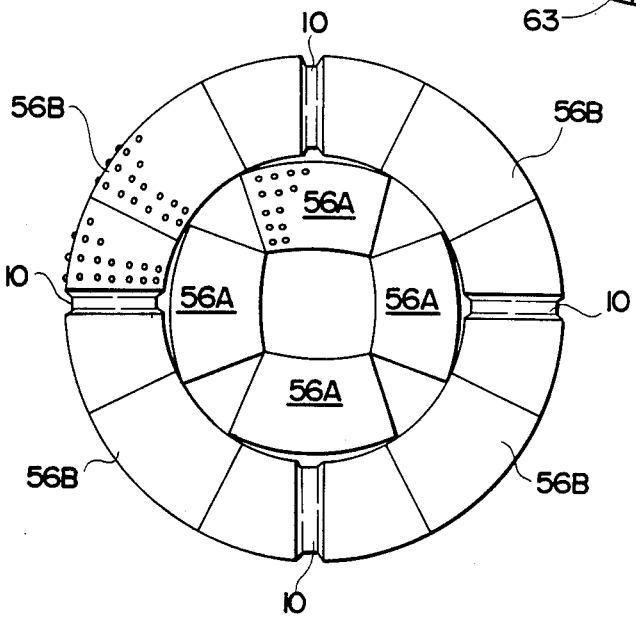
FIG. 15 is a view showing the arrangement of a group of upper layer blade sections when removing a first upper layer bit head division.

The bit body 2 has at a substantially middle portion of its inner surface two annular ridges 50 and 51 which are provided for fixing the upper layer bit head 3. The annular ridge 50 which is located closer to the bit head 9 is formed with guide grooves 52 which are of the same number as the above water grooves 10 and located at equal intervals, while the other annular ridge 51 which is located closer to the base end of the bit body 2 is formed with guide grooves 53 which are located at positions corresponding to alternate ones of the water grooves 10. Also, protruding portions 13D and 13E are fixed to the bit body 2 by a suitable method such as welding which protrude from the inner surface of the bit body 2, respectively, at a position between the annular ridges 50 and 51, and a position at one side of the ridge 51 closer to the base end of the bit body 2, the protruding portions 13D and 13E extending parallel with the guide grooves 52 and 53, and being provided for the purpose of maintaining the fixed position of the upper layer bit head 3. As shown in FIG. 13, the protruding portions 13D and 13E are provided on their radially inner sides, respectively, with portions 15D and 15E which are to be sheared off, each of which has its circumferential ends formed into the shape of a wedge with respect to the inner surface of the bit body 2, and is made of an alloy, e.g. an Zn alloy, which is softer than the material of a ring member 62, decscribed later.

Figure 12:
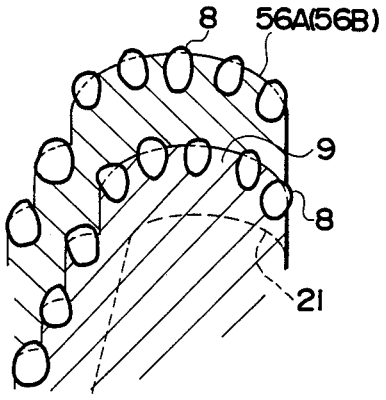
FIG. 12 is a fragmentary longitudinal sectional view taken long the line XII—XII in FIG. 11.

On the outer surface of the tip end of the bit head 9 of the bit body 2, the upper layer bit head 3 is superposedly fitted, which head 3 comprises blade sections 56 divided into a plurality of blade groups. Each blade section 56 includes diamonds 8 embedded in its outer surface, is formed in such a manner that the cutting blade area thereof is equal to that of each one of the cutting blades 11 of the bit body 2 which are defined by the water grooves 10, and is superposedly fitted on the bit head 9. Therefore, between adjacent ones of the blade sections 56, grooves 58 having the same circumferential width as those of the water grooves 10 are formed, the former grooves 58 also serving as water grooves. The blade sections 56 are provided on their inside with shanks 21 (as best shown in FIG. 12) each of which is formed into a configuration which is suitable for fitting into the corresponding water groove 10.

Figure 11:
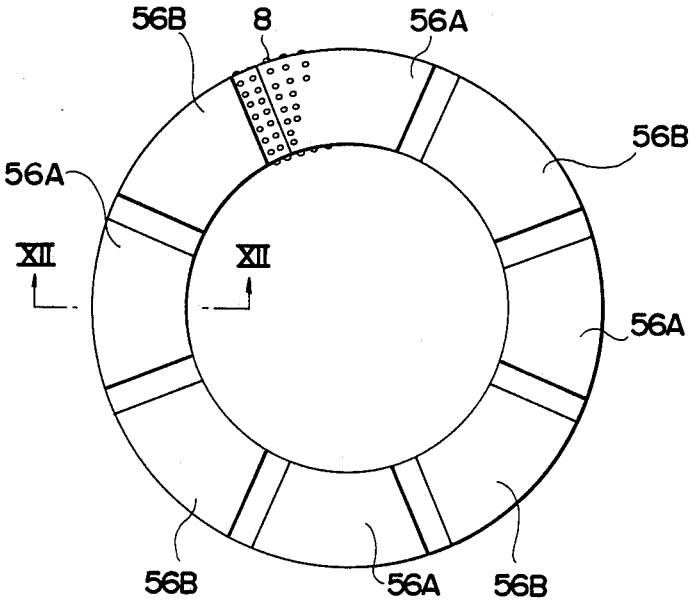
FIG. 11 is a view showing the arrangement of the upper layer bit head of the drill bit shown in FIG. 9.

In order to fix the blade sections 56 at their fixed positions, the arrangement in accordance with this embodiment is such that the blade sections 56, which are eight in number, are fixed in groups each of which consists of four blade sections 56 alternately arranged on the bit head 9. Therefore, according to this arrangement, between blade sections 56A belonging to one blade group formed by a first upper layer bit head division 3A, a blade section 56B belonging to the other blade group formed by a second upper layer bit head division 3B is arranged, as shown in FIG. 11.

Figure 9:
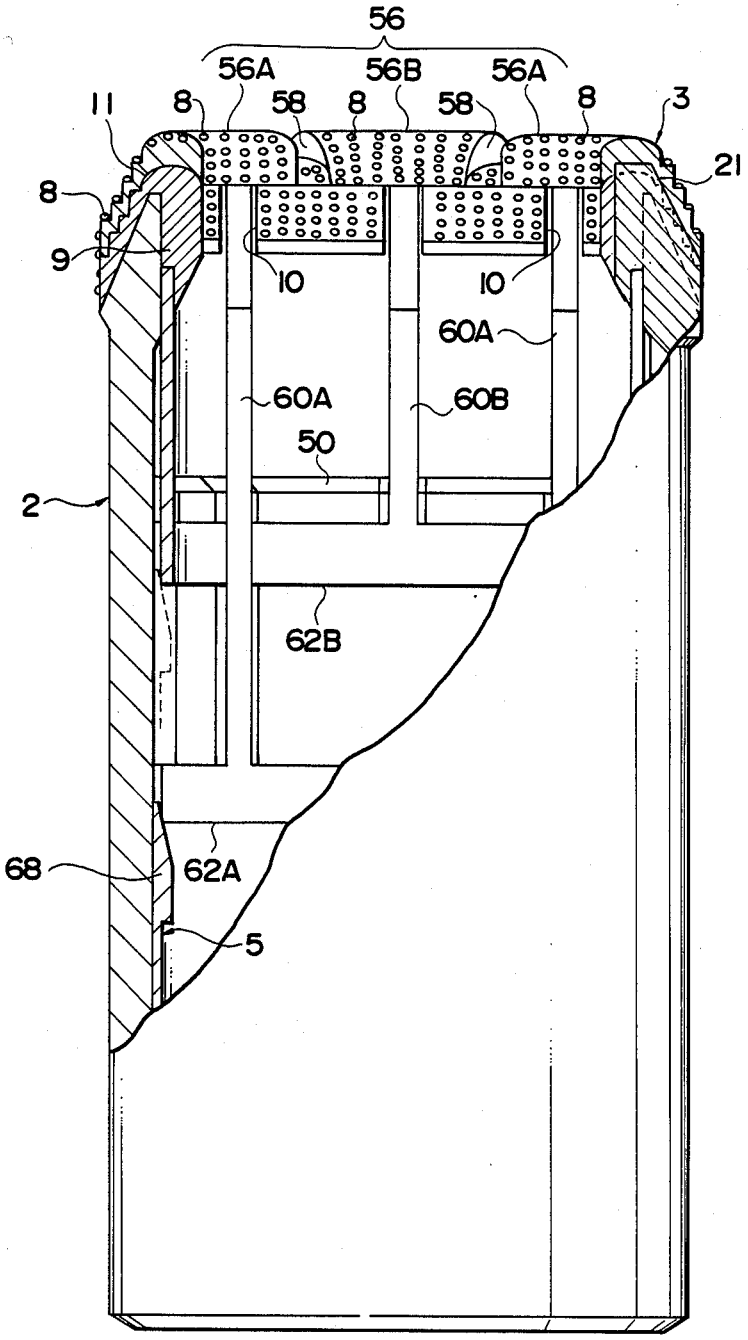
FIG. 9 is a fragmentary longitudinal sectional view of a drill bit of the surface-type in accordance with a second embodiment of the invention, in which an upper layer bit head is superposedly fitted on a bit head of a bit body.
Figure 10:
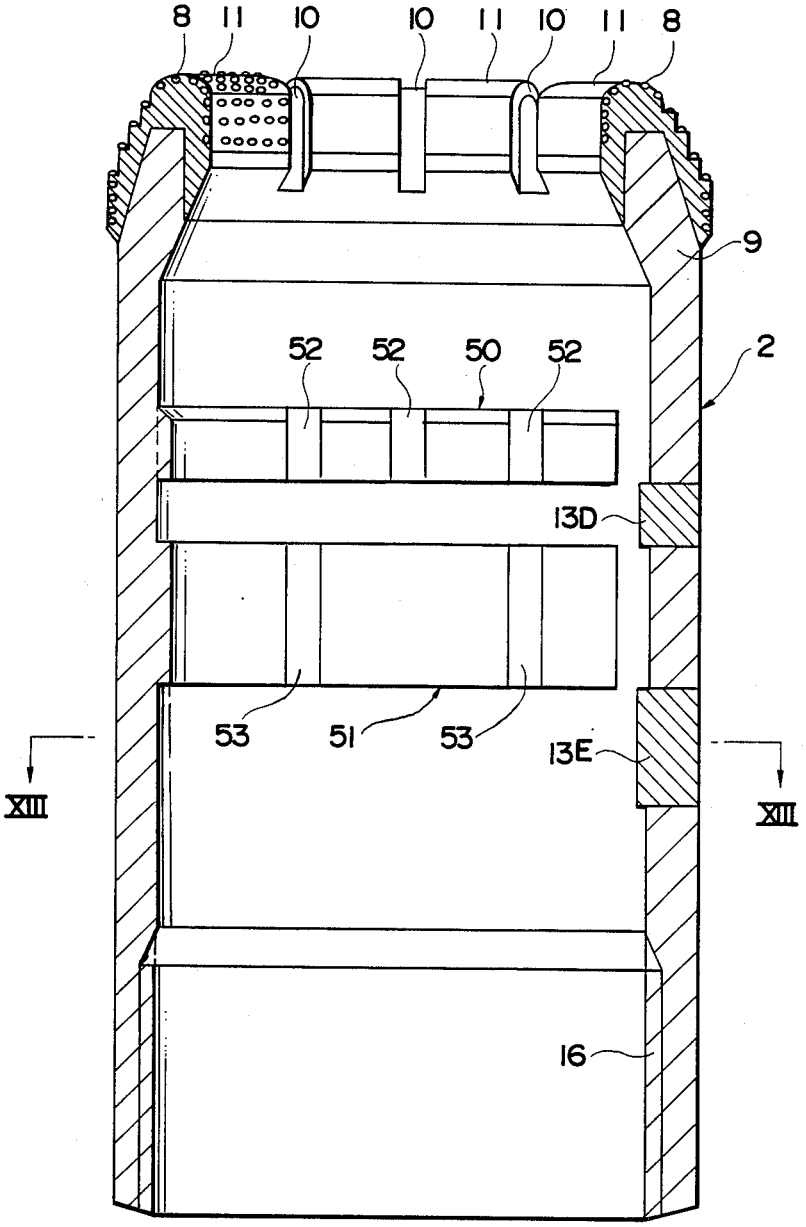
FIG. 10 is a longitudinal sectional view of the bit body shown in FIG. 9.

The above blade sections 56A belonging to the first group and the blade sections 56B of the second are arranged independently from each other. More specifically, as shown in FIG. 9, the first group of blade sections 56A and the second group of blade sections 56B are respectively connected to longer legs 60A and shorter legs 60B which are connected to the shanks 21 at the inside of the blade sections 56. The legs 60A and 60B are respectively connected at their other ends, to a ring 62A and a ring 62B which are disposed circumferentially along the inner peripheral surface of the bit body 2. The rings 62 are each formed by an annular-shaped strip plate, and are each formed with a slit 63 to allow for variations in diameter and thus act as an elastic member. The circumferential ends of the slits 63 are formed into the shape of a wedge so as to be engageable with the portions 15D and 15E of the protruding portions 13D and 13E. That is, the legs 60 and the rings 62 are arranged in the following manner: The slit 63 of the ring 62B is opened by moving its circumferential ends away from each other in the circumferential direction, with the diameter of the ring 62B being thus increased, and the above ends of the slit 63 are then brought into engagement with the circumferential end surfaces of the portion 15D which is to be sheared off from the rest of the protruding portion 13D, thereby positioning the ring 62B along the inner peripheral surface of the bit body 2. On this occasion, the legs 60B connected to the ring 62B are fitted into the guide grooves 52 formed in the annular ridge 50, whereby their circumferential positions are determined, while being in contact with the end ridge of the ring 62B and with the walls of the annular ridge 50, and thereby serving to prevent disengagement of the second group of the blade sections 56B. On the other hand, the other ring 62A is arranged in a similar manner to that of the ring 62B except that it is arranged such that the legs 60A are positioned at circumferential intervals each of which is twice as large as that of the legs 60B. On this occasion, the legs 60A connecting the ring 62A and the first group of blade sections 56A are fitted into the guide grooves 52 and 53 formed respectively in the ridges 50 and 51. The legs 60A and the legs 60B connecting respectively the first group of blade sections 56A and the ring 62A, and the second group of blade sections 56B and the ring 62B have elastic forces which act in such a manner that the blade sections 56 are urged radially inwardly. Therefore, when the blade sections 56 have been removed from their superposed positions, each of the first group of blade sections 56A and the second group of blade sections 56B can be converged toward the radially inward direction, the diameter of a virtual circumcircle around the converged group of blade sections 56A or 56B being less than the inner diameter of the bit body 2, thereby enabling withdrawal of each of the blade section groups through the inside of the bit body 2. As a result of these arrangements, when the upper layer bit head divisions 3 have been removed from their superposed positions, the divisions 3 can be withdrawn one by one by being passed through the inside of the bit body 2.

The drilling of a bore is performed by the above upper layer bit head divisions 3 which are fitted on the bit head 9 of the bit body 2 in the condition of being superposedly layered on the same. The drill bit is provided with a disengagement mechanism 5 (shown in FIG. 16) received within the bit body 2 which is provided for removing the upper layer bit head 3 when the usable life of the blade sections 56 of the upper layer bit head divisions 3 has ended. The disengaging mechanism 5 comprises an annular plate 66 disposed around the inner peripheral surface of the bit body 2, and wedges 68 formed in a protruding manner from a ridge portion of the annular plate 66 facing the bit head 9 of the bit body 2. The wedges 68 are formed at circumferential positions aligned with the guide grooves 53 formed in the annular ridge 51 which is closer to the base end of the bit body 2, the wedges 68 corresponding in number (which is four in this embodiment) to the guide grooves 53, with the tip ends of the wedges 68 being located at such positions that they are able to slidably enter the gap between the inner peripheral surface of the bit body 2 and the outer peripheral surface of the ring 62A. With the above construction, by knocking the annular plate 66 at its ridge closer to the base end of the bit body 2 in a manner described later, the wedges 68 operate firstly on the ring 62A to disengage the same 62A from the protruding portion 13E, thus causing reduction of the ring 62A in diameter, to thereby remove the corresponding first group of blade sections 56A. Subsequently, by axially advancing the wedges 68, the wedges 68 are made to slide within the guide grooves 53 to operate, at this time, on the ring 62B, causing the same effects as above.

Figure 16:
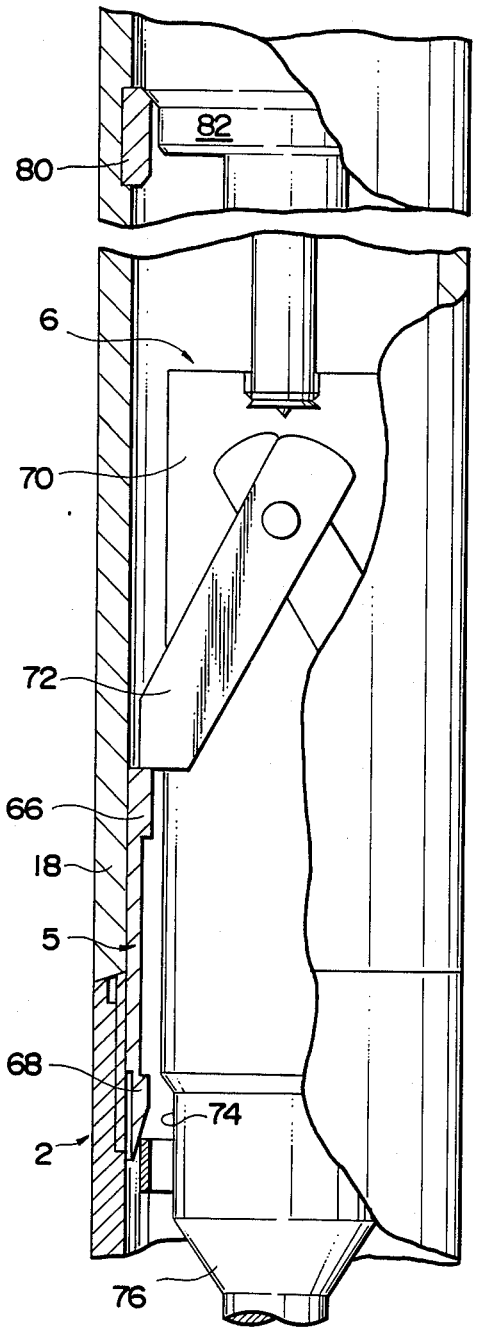
FIG. 16 is a fragmentary longitudinal sectional view of a boring rod which shows a withdrawal mechanism for the drill bit shown in FIG. 9.
Figure 17:
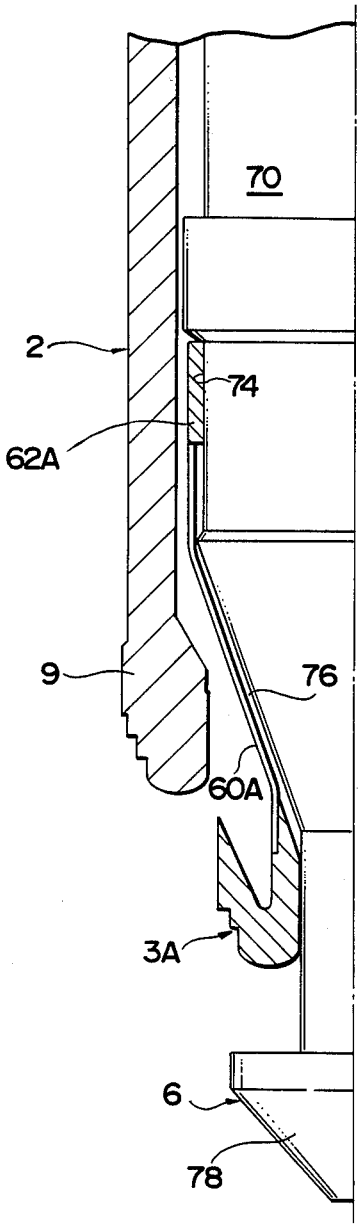
FIG. 17 is a fragmentary longitudinal sectional view showing a manner in which the upper layer bit head of the drill bit shown in FIG. 9 is removed.

A withdrawal mechanism 6 is to be assembled on the drill bit in order to remove the divided bit head 3 from the bit body 2 and withdraw the removed bit head 3 for bringing the same up to the ground. As shown in FIGS. 16 and 17, the withdrawal mechanism 6 is hung down within the boring rod 18 toward the bottom of the bore, so as to actuate the above disengaging mechanism by utilizing its own weight and thereby remove the upper layer bit head 3 from the bit body 2 and bring it up to the ground. The withdrawal mechanism 6 includes a withdrawal body 70 hung down within the boring rod 18, and a latch portion 72 mounted on the body 70, which has a pair of arm members one of which is pivotally mounted and opened with the tip end thereof protruding in the lateral direction. The latch portion 72 serves, when the mechanism 6 is hung down, to knock against the ridge of the annular plate 66. The withdrawal body 70 has, at the side thereof which is closer to the bit body 2, a clearance-forming portion 74 which has a small diameter for receiving the rings 62A and 62B, a tapered surface 76 having a diameter which decreases toward the tip end of the body 70, and a conical head 78 forming the tip end of the body 70. With the above construction, therefore, by hanging down the body 70, the latch portion 72 is caused to knock the annular plate 66 at its ridge, which leads to disengagement of the first ring 62A in the above-mentioned manner, and this is followed by removal of the first upper layer bit head division 3A in the manner shown in FIG. 17, the first group of the blade sections 56A of the bit head division 3A being converged by the elastic force of the legs 60A around the outer peripheral surface of the withdrawal body 70 at the side thereof which is closer to its tip end, and finally being withdrawn upwardly in the state shown in FIG. 15. Incidentally, a stopper ring 80 (FIG. 16) is provided for the boring rod 18 which serves to prevent the positions of the wedges 68 from causing the disengagement of the second ring 62B together with the first ring 62A when the latter 62A is being disengaged. More specifically, the stopper ring 80 supports a withdrawal base portion 82 so that in this supported position of the base portion 82, any excess advancement of the withdrawal body 70 can be prevented. After the disengagement of the first ring 62A, which is immediately followed by the withdrawal of the first upper layer bit head division 3A, a second withdrawal operation follows in which another withdrawal body 70 which has the same configuration as the previous withdrawal body 70 but is different in axial length therefrom is mounted and hung down within the boring rod 18. The arrangement is such that a latch portion 72 again knocks the annular plate 66 so as to disengage the second ring 62B. Meanwhile, the stopper ring 80 is provided for prevention of any breakage of the bit body 2 and for adjustment of the length of the withdrawal bodies 70 and 70 at the time of the first and second withdrawal operations.

The drill bit constructed as above operates as follows: When the upper layer bit head 3 is to be assembled on the bit body 2, the second upper layer bit head division 3B is inserted from the opening of the bit body 2 at its base end, which is followed by fitting the first group of four blade sections 56B on the bit head 9 of the bit body 2. The ring 62B is opened at the slit 63 to be brought into engagement with the protruding portion 13D. Next, the first upper layer bit head division 3A is fitted in the same manner. When the assembly is thus completed, the bit body 2 on which the upper layer bit head 3 is assembled is screwed on the boring rod 18. This screwed position of the bit body 2 is set at a position in which the wedges 68 do not operate.

The above drill bit is used in drilling a bore, the blade sections 56 being used firstly. During this drilling operation, cooling of the bit head 3 being used can be effected to the same extent as in the case of the cutting blades 11 of the bit head 9 of the bit body 2, since the grooves 58 located between adjacent ones of the blade sections 56 and serving as water grooves each has the same circumferential size as that of each water groove 10 by virtue of the equality of the cutting blade area of the blade sections 56 relative to that of the cutting blades 11 of the bit head 9. When the drilling proceeds to a certain depth and the blade sections 56 have become worn out, the blade sections 56 are removed in the following manner: A core tube (not shown) is pulled up out of the bore being drilled, and the withdrawal mechanism 6 is lowered within the boring rod 18. By thus lowering the mechanism 6, the latch portion 72 knocks the annular plate 66, which causes the movement of the wedges 68, with respect, firstly, to the first ring 62A. This causes the ring 62A to shear off the portion 15E so as to be released from its engaged condition with the protruding portion 13E and be reduced in diameter, the thus disengaged and diameter-reduced ring 62A being received into the clearance between the clearance-forming portion 74 and the mating inner peripheral surface of the bit body 2. Thereafter, the wedges 68 are brought into suitable positions in the vicinity of the second ring 62B, while any advancement of the wedges 68 beyond such positions is prohibited by the stopper ring 80. During this time, the withdrawal body 70 together with the first upper layer bit head division 3A advance slightly axially in the direction of the latter, the first group of four blade sections 56A becoming disengaged from their fitted position on the bit body 2, and being converged by the elastic force of the legs 60A in the manner shown in FIG. 15 around the tip end portion of the withdrawal body 70. The first upper layer bit head 3A is then pulled up to the ground together with the withdrawal body 70. Then, by lowering another withdrawal body 70, the second upper layer bit head 3B comprised of the first group of four blade sections 56B are similarly brought up to the ground.

According to the second embodiment of the invention, the upper layer bit head 3 which is fitted on the bit body 2 in a superposedly layered condition is removed from its fitted position and withdrawn in two steps, thereby enabling the cutting blade area of the upper layer bit head 3 to enlarge to such an extent that that cutting blade area will be substantially the same as that of the bit head 9 of the bit body 2. This is advantageous for the following reason: The usable life of the cutting blades of a drill bit is determined in accordance with the cutting blade area which is an exclusive area in which particles of diamonds are embedded. If the blade sections 56 are to be removed and withdrawn in one step even though they are divided, the cutting blade area of the blade sections 56 would amount to only 64% of that of the bit head 9 of the bit body 2, which would result in an insufficient cutting blade area in terms of improving the usable life of the blade sections. On the other hand, according to this embodiment of the invention, by virtue of the two-stepped removal and withdrawal of the upper layer bit head 3, withdrawal is made possible even with enlargement of the effective cutting blade area of the blade sections 56, and also the same area can be enlarged to such an extent that it corresponds to 96% of that of the bit head 9 of the bit body 2, thus remarkably lengthening the usable life.

The two previous embodiments of the invention described above show drill bits of the same type, that is, the surface-type in which cutting blades of a bit body are formed in such a manner that the diamonds protrude from the outer surface of the metal body and in which an upper layer bit head is assembled on the outer surface of the cutting blades, the configuration of protrusions of the diamonds being transferred to the inner surface of the upper layer bit head by sintering powder metal. However, since drill bits of this surface-type consume a large amount of diamonds which are expensive, diamond bits of the impregnated-type are often used, in which the cutting blades of a bit head are formed by mixing relatively fine diamonds and powder metal and infiltration sintering the resulting mixture.

Figure 18:
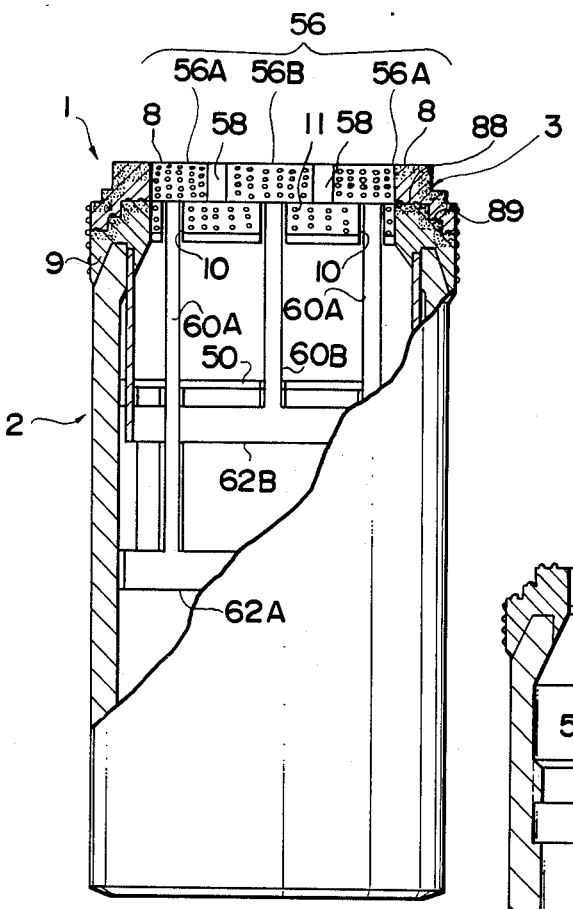
FIG. 18 is a fragmentary longitudinal sectional view of an embodiment of a diamond bit of the impregnated-type in accordance with the invention, in which an upper layer bit head is superposedly fitted on a bit head of a bit body.
Figure 19:
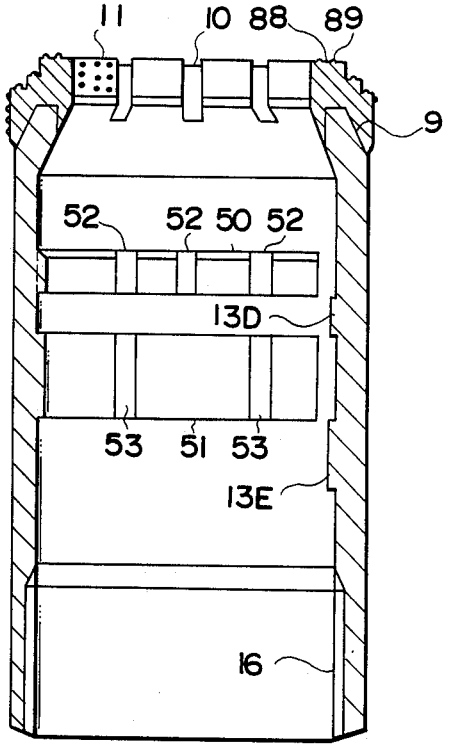
FIG. 19 is a fragmentary longitudianl secitonal view of the bit body shown in FIG. 18.

FIGS. 18 and 19 show an embodiment of a diamond bit of the impregnated-type in accordance with the invention.

A diamond bit 1 for core boring which is of the impregnated-type has a bit body 2 and an upper bit head 3.

The bit body 2 is formed into a cylinder-like shape, and has a bit head 9 at the tip end thereof to be used in the drilling operation. The bit head 9 has a tip end which is made by mixing diamonds and powder metal and infiltration sintering the resulting mixture. Preferably, the sintering temperature should be on the order of 1000° C. which is below 1050° C., the temperature above which the properties of diamonds will change. In the bit head 9, a plurality of water grooves 10 which extend continuously in the inner and outer surfaces of the bit head 9 are formed. More specifically, eight grooves 10 are formed, as in the previous embodiments, radially at equal intervals, whereby eight blade sections 11 are formed in the bit head 9. The outer surface 88 of the blade sections 11 at the tip end thereof (the tip end outer surface 88 will be hereinafter referred to as "the surface to be layered" unless otherwise specified) is formed therein with a plurality of protrusions 89. The structure of the bit body 2 at its inner surface is the same as that shown in FIG. 9, detailed description of which will be omitted.

As shown in FIG. 18, the divided upper layer bit head 3 which consists of a plurality of outer layer blades 56 divided into a plurality of groups is fitted on the tip end outer surface of the bit head 9 of the bit body 2. In order to attain this fitting, the configuration of the inner peripheral surface of the outer layer blades 56 is transferred from that of the surface to be layered 88 including the corresponding protrusions 89 of the bit body 2, which transfer is carried out by sintering powdered metals. Preferably, the sintering temperature should be on the order of 900° C., which is below the sintering temperature of the bit body 2.

Each one of the outer layer blades 56 of the divided bit head 3 is formed by embedding diamonds in the outer surface thereof in a manner such that the cutting blade area thereof becomes the same as that of each one of the blade sections 11 of the bit body 2 which are defined by the water grooves 10. Therefore, between two adjacent ones of the outer layer blades 56 of the bit head 3, grooves 58 are formed, each of which has the same circumferential size as that of the water groove 10, the grooves 58 also serving as water grooves.

The construction of the upper layer bit head 3, assembly of the same on the bit body 2, and removal of the same from its fitted position may be the same as in the embodiment described above with reference to FIGS. 9 to 11, description of which will be omitted.

When drilling a bore by using the above drill bit, the inner peripheral surface of the divided upper layer drill bit 3 which is to be fitted in a superposedly layered condition on the surface to be layered 88 of the bit body 2 has a configuration which is transferred from the configuration of the surface to be layered 88 including the protrusions 89, thereby producing a large frictional resistance between these surfaces, and thus preventing any displacement of the divided bit head 3 relative to the bit body 2 and thereby obtaining a stable layered condition which will ensure improved efficiency of the drilling operation.

I claim:

1. A drill bit for core boring of the type provided with a multi-layered bit head, comprising:

a cylindrical bit body provided at the tip portion thereof with a bit head having cutting blades and at an inner surface thereof with at least one protruding portion;

an upper layer bit head having upper layer blades superposedly fitted on said cutting blades, a plurality of legs each fixed at one end thereof to the corresponding one of said upper layer blades and extending in the axial direction of said bit body, and at least one ring extending in the circumferential direction of said bit body in such a manner as to be connected to at least part of said legs and engageable with said at least one protruding portion, the diameter of said ring being capable of reduction; and a disengaging mechanism received within said bit body and operable to disengage the engagement of said at least one ring with said at least one protruding portion, said cutting blades of said bit body having an outer peripheral surface of an irregular configuration, said upper layer blades having an inner peripheral surface of a configuration transferred from said irregular configuration of the outer peripheral surface of said cutting blades of said bit body, said protruding portion of said bit body being provided with a portion shearably attached thereto, said portion adapted to be sheared off by shearing force of said ring of said upper layer bit head which works circumferentially when the diameter of said ring is reduced.

2. A drill bit as claimed in claim 1, wherein said drill bit is a diamond bit of the surface-type in which said cutting blades of said bit body are formed by embedding a number of diamonds in the outer surface of said bit head.

3. A drill bit as claimed in claim 1, wherein said drill bit is a diamond bit of the impregnated-type in which said cutting blades of said bit body are formed by mixing relatively fine diamonds and metal powder and sintering the resulting mixture, the outer surface of said cutting blades at the tip end thereof including a plurality of protrusions.

4. A drill bit as claimed in claim 1, wherein said bit head of said bit body has a plurality of grooves and comprises blade sections which are divided into a plurality of groups, and said upper layer blades of said upper layer bit head are divided into a plurality of groups in a manner such that the cutting blade area of said upper layer blades is substantially the same as that of said cutting blades of said bit body.

5. A drill bit as claimed in claim 1, wherein said at least one leg has elasticity which works in the radially inward direction of said bit body, said at least one leg being capable of passing through the inside of said bit body when said upper layer bit head is not in engagement with said bit body.

6. A drill bit as claimed in claim 1, wherein said at least one ring has a slit, said slit of said ring and said portion to be sheared off of said protruding portion being engageable with each other in a wedge-shaped manner.

7. A drill bit as claimed in claim 1, wherein said portion to be sheared off is made of an alloy which is softer than the material of said ring.

8. A drill bit as claimed in claim 1, wherein the inner surface of said bit body is formed therein with a plurality of grooves for guiding said legs of said upper layer bit head.

9. A drill bit as claimed in claim 8, wherein said disengaging mechanism includes wedge means capable of entering between said grooves and said ring.

10. A drill bit as claimed in claim 1, further including a withdrawal mechanism operable to actuate said disengaging mechanism and to withdraw said upper layer bit head through the inside of said bit body.

* * * * *